US011395568B2

(12) United States Patent
Chen et al.

(10) Patent No.: US 11,395,568 B2
(45) Date of Patent: Jul. 26, 2022

(54) MULTIFUNCTIONAL CLEANING DEVICE

(71) Applicant: ASIA VITAL COMPONENTS CO., LTD., New Taipei (TW)

(72) Inventors: Mao-Lin Chen, New Taipei (TW); Yu-Tzu Chen, New Taipei (TW); Bor-Haw Chang, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 541 days.

(21) Appl. No.: 16/600,591

(22) Filed: Oct. 14, 2019

(65) Prior Publication Data

US 2021/0106192 A1 Apr. 15, 2021

(51) Int. Cl.

| | |
|---|---|
| ***A47L 7/00*** | (2006.01) |
| ***A47L 9/28*** | (2006.01) |
| ***A47L 11/294*** | (2006.01) |
| ***A47L 11/40*** | (2006.01) |

(52) U.S. Cl.

CPC ..... *A47L 7/0014* (2013.01); *A47L 9/2826* (2013.01); *A47L 9/2842* (2013.01); *A47L 11/294* (2013.01); *A47L 11/4002* (2013.01); *A47L 11/4066* (2013.01); *A47L 11/4083* (2013.01); *A47L 11/4088* (2013.01); *A47L 2201/04* (2013.01); *A47L 2201/06* (2013.01)

(58) Field of Classification Search

CPC .... A47L 7/0014; A47L 9/2826; A47L 9/2842; A47L 11/294; A47L 11/4002; A47L 11/4066; A47L 11/4083; A47L 11/4088; A47L 2201/04; A47L 2201/06

See application file for complete search history.

(56) References Cited

FOREIGN PATENT DOCUMENTS

| | | | |
|---|---|---|---|
| CN | 203468522 | U | 3/2014 |
| CN | 204146957 | U | 2/2015 |
| CN | 107334428 | A | 11/2017 |
| CN | 108553032 | A | 9/2018 |
| CN | 168814429 | A | 11/2018 |
| CN | 208144970 | U | 11/2018 |
| CN | 109431380 | A | 3/2019 |
| CN | 208625576 | U | 3/2019 |
| CN | 208864220 | U | 5/2019 |
| CN | 109917488 | A | 6/2019 |
| CN | 208957999 | U | 6/2019 |

(Continued)

OTHER PUBLICATIONS

Search Report dated Dec. 2, 2019 issued by Taiwan Intellectual Property Office for counterpart application No. 108133401.

(Continued)

*Primary Examiner* — Andrew A Horton

(74) *Attorney, Agent, or Firm* — Bradley J. Thorson; DeWitt LLP

(57) ABSTRACT

A multifunctional cleaning device includes a main body, a telescopic tube body, a cleaning head set and a control unit. Multiple drive units are mounted on one side of the main body. The main body has a detection unit for detecting cleaning range and path. The telescopic tube body is telescopically connected with the main body. The telescopic tube body has a first end and a second end. The first and second ends are respectively connected with the main body and the cleaning head set in communication therewith. The control unit is disposed in the main body to execute system control and judge received signals so as to give commands to the drive units for controlling the move of the main body.

10 Claims, 5 Drawing Sheets

(56) References Cited

FOREIGN PATENT DOCUMENTS

| | | | |
|---|---|---|---|
| JP | 2015051336 | A | 3/2015 |
| TW | 201907852 | A | 3/2019 |

OTHER PUBLICATIONS

Search Report dated Sep. 25, 2020 issued by China National Intellectual Property Administration for counterpart application No. 2019108773994.

MULTIFUNCTIONAL CLEANING DEVICE

BACKGROUND OF THE INVENTION

1. Field of the Invention

The present invention relates generally to a cleaning device, and more particularly to a multifunctional and multiuse cleaning device.

2. Description of the Related Art

A broom is a simplest tool for sweeping and cleaning up the garbage on the ground. The broom can be used to clean up the garbage on the ground in a small range. However, with respect to a large range of ground, the cleaning efficiency of the broom is extremely low. In order to achieve cleaning effect with less strength, various vacuum cleaners have been developed and commercially available. The conventional vacuum cleaners can be further classified into a handheld vacuum cleaner that can be controlled by a user himself/herself and a non-handheld robot vacuum cleaner. The robot vacuum cleaner can automatically sweep off and collect the garbage on the ground in its moving path.

However, both the conventional handheld vacuum cleaner and the robot vacuum cleaner have their shortcomings. For example, the handheld vacuum cleaner has better dust-sucking effect. However, the handheld vacuum cleaner needs a user to manually hold and operate. The robot vacuum cleaner can operate without the control of a user. However, due to the limitation of the volume and structure of the robot vacuum cleaner, the robot vacuum cleaner can hardly get into the areas with a lot of obstacles or the areas low under some articles (such as a chair, a table or furniture). Therefore, the robot vacuum cleaner cannot achieve the dust-sucking effect as the conventional handheld vacuum cleaner. Moreover, in the case that during the cleaning process, the robot vacuum cleaner encounters an obstacle and is unable to come out, the robot vacuum cleaner will clog and fail to further operate. In addition, a non-handheld robot mopping device is now on the market. Such non-handheld robot mopping device has the same problem as the non-handheld robot vacuum cleaner. Due to the limitation of the volume and structure, the robot mopping device has poor mopping and cleaning effect and needs to be improved.

It is therefore tried by the applicant to provide a multifunctional cleaning device to solve the above problems existing in the conventional cleaning devices.

SUMMARY OF THE INVENTION

It is therefore a primary object of the present invention to provide a multifunctional cleaning device, which is a multiuse cleaning device with multiple functions.

It is a further object of the present invention to provide the above multifunctional cleaning device, which has greatly enhanced cleaning effect.

It is still a further object of the present invention to provide the above multifunctional cleaning device, which has both cleaning and mopping functions.

It is still a further object of the present invention to provide the above multifunctional cleaning device, which can adjust the cleaning force in accordance with different materials of the grounds.

It is still a further object of the present invention to provide the above multifunctional cleaning device, which also has transfer function.

To achieve the above and other objects, the multifunctional cleaning device includes a main body, a telescopic tube body, a cleaning head set and a control unit. Multiple drive units are mounted on one side of the main body. The main body has a detection unit for detecting cleaning range and path. The telescopic tube body is telescopically connected with the main body. The telescopic tube body has a first end and a second end. The first end is connected with one end of the main body in communication with the main body. The second end is correspondingly connected with the cleaning head set. The cleaning head set communicates with the telescopic tube body. The control unit is disposed in the main body to execute system control and judge received signals so as to give commands to the drive units for controlling the move of the main body.

By means of the structural design of the present invention, the main body of the multifunctional cleaning device has the detection unit for detecting the cleaning range and path. Moreover, the control unit serves to control and give commands to the drive units for controlling the move of the main body. Also, the main body is equipped with the telescopic tube body in cooperation with the cleaning head set to work in a form simulating the conventional handheld vacuum cleaner.

Furthermore, the cleaning head set is further equipped with a detection module. The detection module serves to detect different materials of grounds to adjust the cleaning force of the cleaning head set. The cleaning head set includes a sucker unit and a nozzle unit. The sucker unit serves to execute vacuum cleaning mode, while the nozzle unit serves to execute mopping mode. According to the use requirement, a user can freely switch the cleaning head set between the sucker unit and the nozzle unit.

In addition, the multifunctional cleaning device further has a carrier unit correspondingly mounted on the main body. An article needing to be transferred can be placed on the carrier unit. By means of the drive units of the main body, the article can be moved and transferred to any desired place. Therefore, the multifunctional cleaning device of the present invention has the advantages of the currently commercially available conventional vacuum cleaner, robot vacuum cleaner and robot mopping device as a combination thereof to greatly enhance the cleaning effect. Also, the multifunctional cleaning device has the additional function of moving and transferring the article. Accordingly, the multifunctional cleaning device of the present invention is a multiuse cleaning device.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
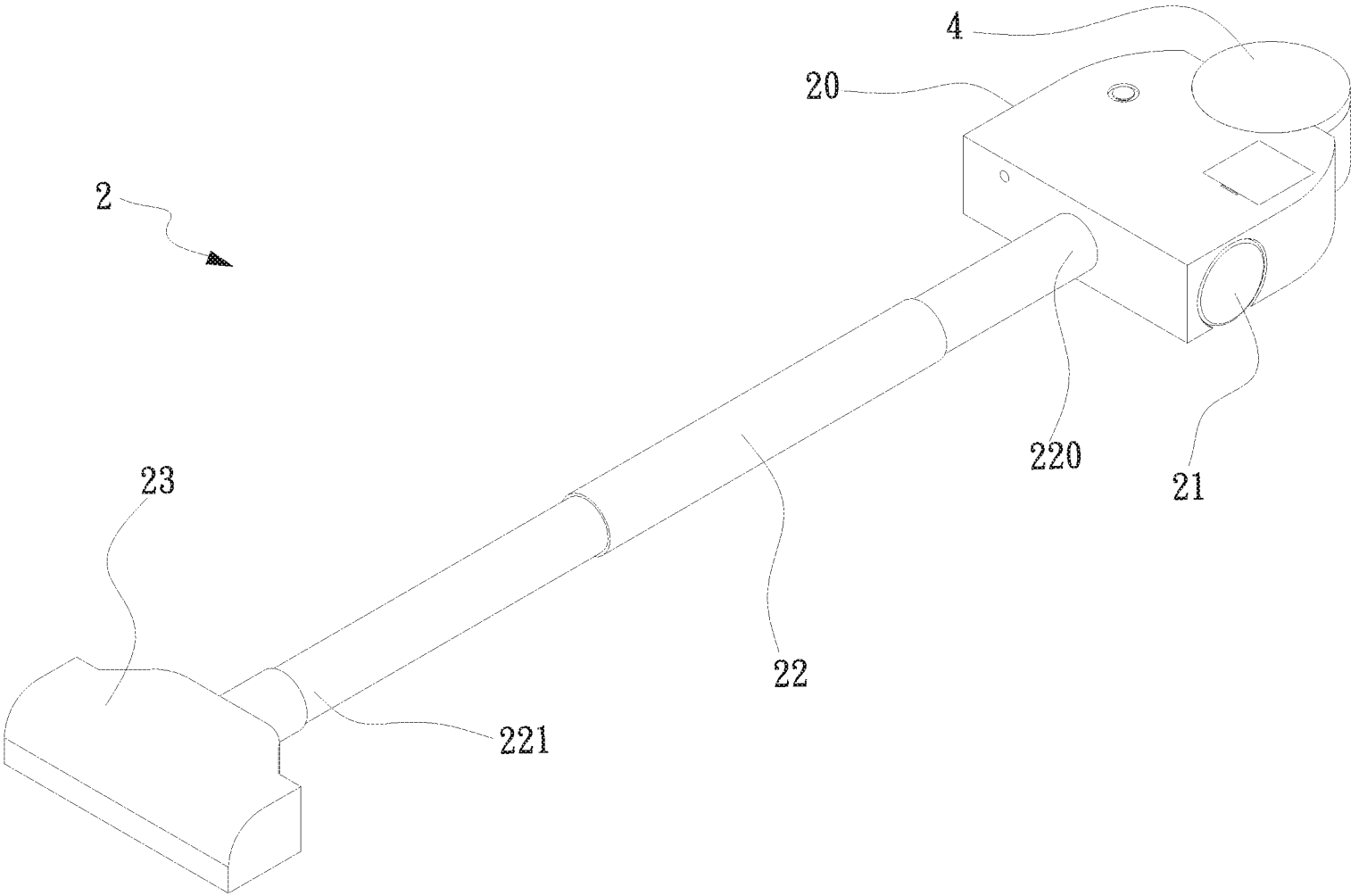
FIG. 1 is a perspective view of the multifunctional cleaning device of the present invention.
Figure 2:
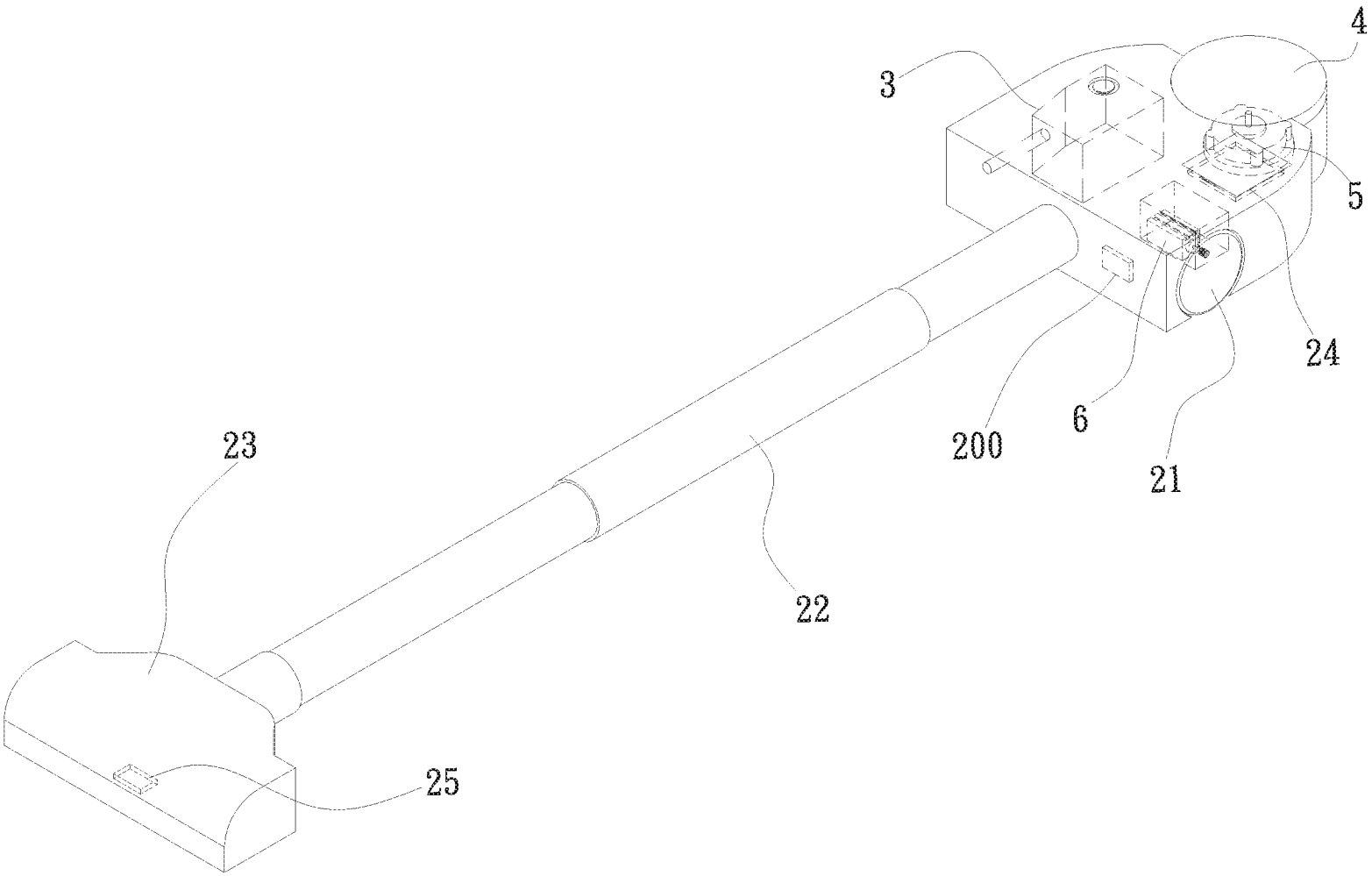
FIG. 2 is a perspective view of the multifunctional cleaning device of the present invention.
Figure 3:
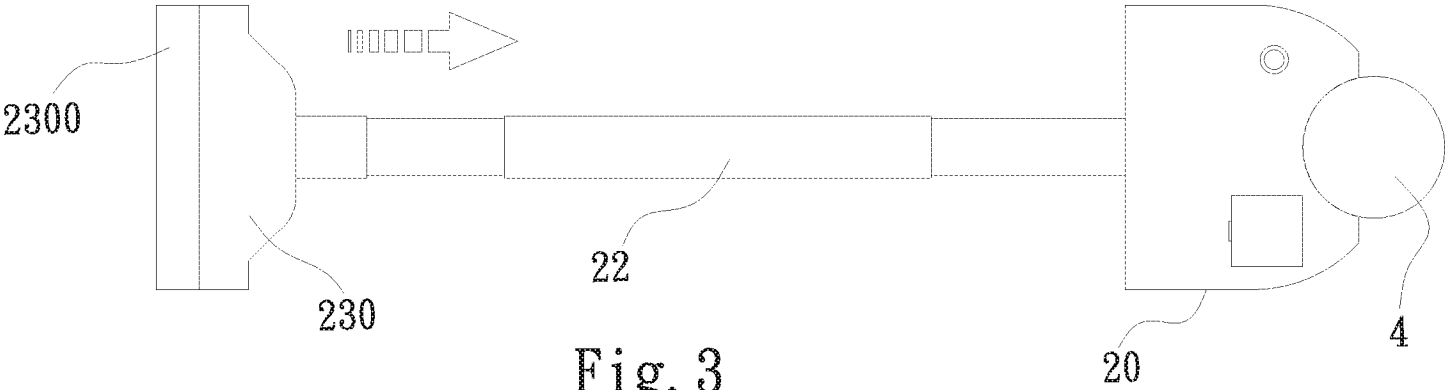
FIG. 3 is a plane view showing the operation of the telescopic tube body of the multifunctional cleaning device of the present invention.
Figure 4:
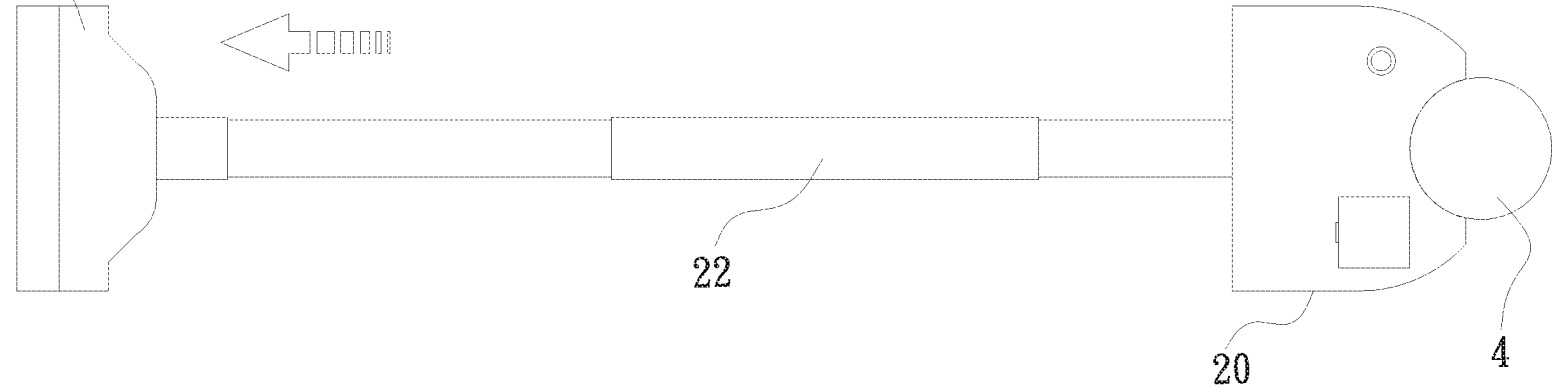
FIG. 4 is a plane view showing the operation of the telescopic tube body of the multifunctional cleaning device of the present invention.

Please refer to FIGS. 1 and 2. FIG. 1 is a perspective view of the multifunctional cleaning device of the present invention. FIG. 2 is a perspective view of the multifunctional cleaning device of the present invention. As shown in the drawings, the multifunctional cleaning device 2 of the present invention includes a main body 20, a telescopic tube body 22, a cleaning head set 23 and a control unit 24. Multiple drive units 21 are mounted on one side of the main body 20. In addition, the main body 20 has a detection unit 200 for detecting the cleaning range and path. The telescopic tube body 22 is telescopically connected with the main body 20 (as shown in FIGS. 3 and 4) and positioned in parallel to a ground (not shown). The telescopic tube body 22 has a first end 220 and a second end 221. The first end 220 is connected with one end of the main body 20 in communication with the main body 20. The second end 221 is connected with the cleaning set 23 in communication therewith. The control unit 24 is correspondingly disposed in the main body 20 to execute system control and judge received signals so as to give commands to the drive units 21 for controlling the move of the main body 20.

The main body 20 further has a drive motor 6 and a vacuum cleaning motor 5. The drive units 21 are electrically connected with the drive motor 6. The drive motor 6 provides necessary power for the drive units 21 to operate. The vacuum cleaning motor 5 provides necessary power for the multifunctional cleaning device 2 to suck the dust.

The cleaning head set 23 includes a sucker unit 230 and a nozzle unit 231. The sucker unit 230 serves to execute vacuum cleaning mode, while the nozzle unit 231 serves to execute mopping mode. According to the use requirement, a user can selectively connect the sucker unit 230 or the nozzle unit 231 with the second end 221 of the telescopic tube body 22.

The sucker unit 230 further has an opening 2300. When the user connects the sucker unit 230 with the telescopic tube body 22 to execute vacuum cleaning mode, the dust and dirt are sucked into the opening 2300 of the sucker unit 230 to pass through the telescopic tube body 22 and then sucked into a dust collection unit 4 in the main body 20. Accordingly, the dust and dirt can be collected in the dust collection unit 4.

Figure 5:
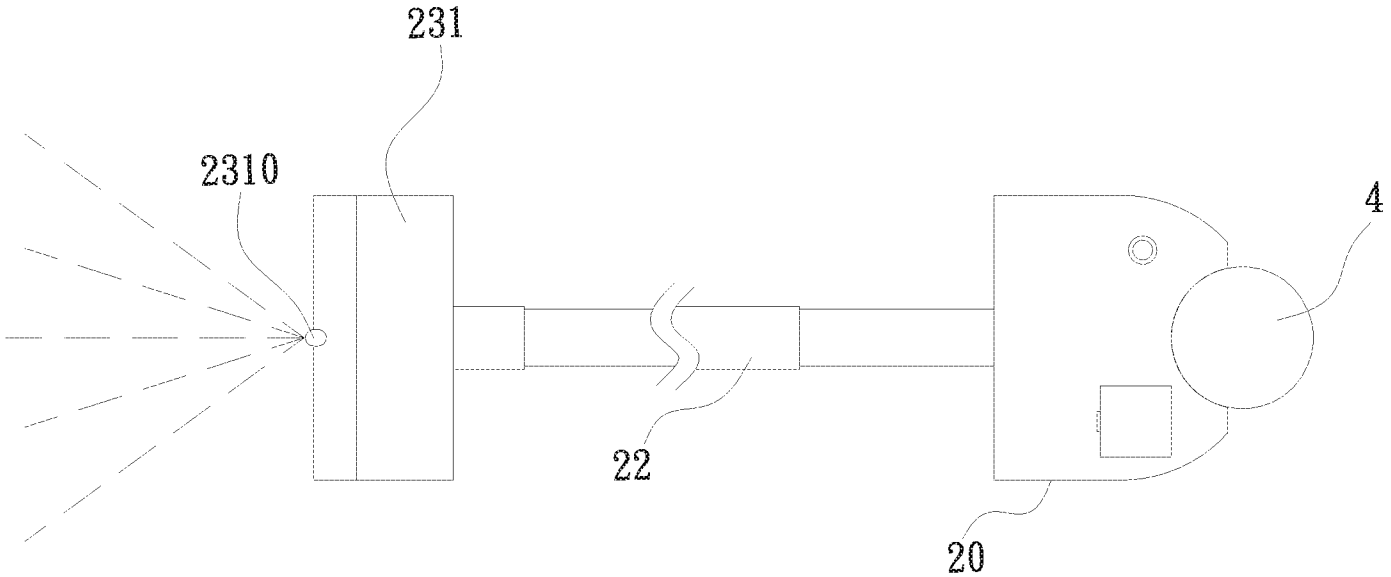
FIG. 5 is a plane view showing that nozzle unit of the multifunctional cleaning device of the present invention sprays a liquid.

Please now refer to FIG. 5. In case the user desires to execute the mopping mode, the nozzle unit 231 is connected with the telescopic tube body 22. In addition, the nozzle unit 231 is formed with at least one water outlet 2310. A liquid reservoir 3 is disposed in the main body 20 for containing a liquid. The water outlet 2310 communicates with the liquid reservoir 3. The control unit 24 serves to control the nozzle unit 231 to spray out the liquid (such as a detergent, tap water or a mixture of liquids). The telescopic tube body 22 can be reciprocally moved to mop (wipe) and dry the ground to achieve cleaning effect.

It should be noted that the cleaning head set 23 is further equipped with a detection module 25. The detection module 25 serves to detect different materials of grounds (such as cement ground, wooden board ground, marble ground, ceramic tile, carpeted ground or rough ground) to adjust the sucking force and mopping force of the cleaning head set 23. Accordingly, during the cleaning process, the ground is prevented from being damaged and a desired cleaning effect can be still achieved.

According to the above arrangement, by means of the structural design of the present invention, the main body 20 of the multifunctional cleaning device 2 has the detection unit 200 for detecting the cleaning range and path. Moreover, the control unit 24 serves to control and give commands to the drive units 21 for controlling the move of the main body 20. Also, the main body 20 is equipped with the telescopic tube body 22 to clean up those places where the conventional robot vacuum cleaner can hardly clean up, (such as the corners and fissures). In addition, the cleaning head set 23 can be cooperatively used to work in a form simulating the conventional handheld vacuum cleaner. In other words, the multifunctional cleaning device 2 has the advantages of the currently commercially available conventional vacuum cleaner, robot vacuum cleaner and robot mopping device as a combination thereof to greatly enhance the cleaning effect.

Figure 6:
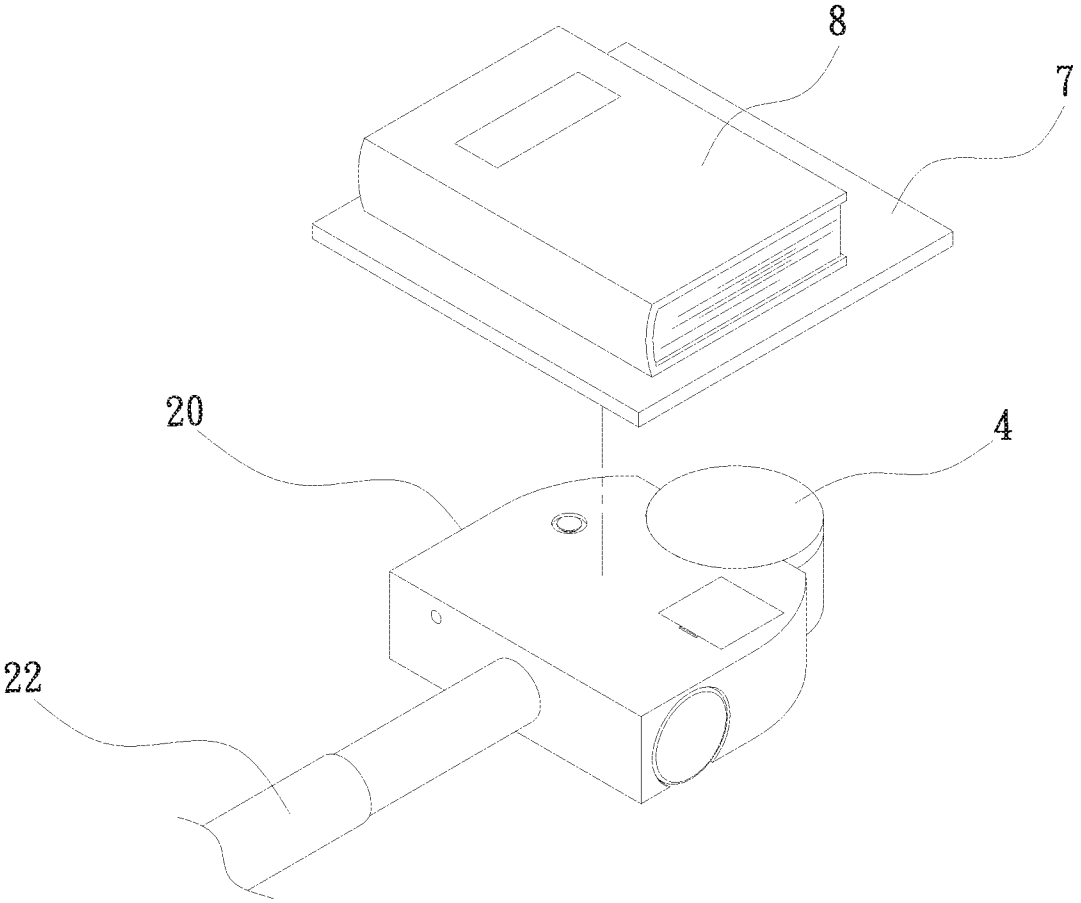
FIG. 6 is a perspective view showing the multifunctional cleaning device of the present invention is used to transfer an article.

In addition, further referring to FIG. 6, the multifunctional cleaning device 2 of the present invention further has a carrier unit 7 correspondingly mounted on the main body 20. An article 8 needing to be transferred can be placed on the carrier unit 7. By means of the drive units 21 of the main body 20, the article 8 can be moved and transferred to any desired place. Therefore, the multifunctional cleaning device 2 also has the additional function of moving and transferring the article 8. Accordingly, the multifunctional cleaning device 2 of the present invention is a multiuse cleaning device 2.

In conclusion, in comparison with the conventional cleaning device, the present invention has the following advantages:

1. The multifunctional cleaning device 2 is a multiuse cleaning device with multiple functions.
2. The multifunctional cleaning device 2 has greatly enhanced cleaning effect.
3. The multifunctional cleaning device 2 has both cleaning and mopping functions.
4. The multifunctional cleaning device 2 can adjust the cleaning force in accordance with different materials of the grounds.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A multifunctional cleaning device comprising:

a main body, multiple drive units being mounted on one side of the main body, the main body having a detection unit for detecting cleaning range and path;

a telescopic tube body telescopically connected with the main body, the telescopic tube body having a first end and a second end, the first end being connected with one end of the main body in communication with the main body;

a cleaning head set correspondingly mounted at the second end of the telescopic tube body in communication with the telescopic tube body; and a control unit disposed in the main body to execute system control and judge received signals so as to give commands to the drive units for controlling the move of the main body.

2. The multifunctional cleaning device as claimed in claim 1, wherein the cleaning head set is further equipped with a detection module, the detection module of the cleaning head set serving to detect different materials of grounds so as to adjust cleaning force.

3. The multifunctional cleaning device as claimed in claim 1, wherein the cleaning head set further includes a sucker unit and a nozzle unit, the second end of the telescopic tube body being connected with one of the sucker unit and the nozzle unit.

4. The multifunctional cleaning device as claimed in claim 3, wherein the nozzle unit is formed with at least one water outlet, the control unit controlling the nozzle unit to spray a liquid from the water outlet to executing mopping mode.

5. The multifunctional cleaning device as claimed in claim 4, wherein a liquid reservoir is further disposed in the main body for containing the liquid, the water outlet communicating with the liquid reservoir.

6. The multifunctional cleaning device as claimed in claim 3, wherein the main body further has a dust collection unit, the sucker unit further having an opening, dust and dirt being sucked into the opening to pass through the telescopic tube body and then sucked into the dust collection unit, whereby the dust and dirt are collected in the dust collection unit.

7. The multifunctional cleaning device as claimed in claim 1, wherein the main body further has a vacuum cleaning motor, the vacuum cleaning motor serving to provide necessary power for the multifunctional cleaning device to suck the dust.

8. The multifunctional cleaning device as claimed in claim 1, wherein the drive units are connected with a drive motor, the drive motor serving to provide necessary power for the drive units to operate.

9. The multifunctional cleaning device as claimed in claim 1, wherein the telescopic tube body is disposed on the main body and positioned in parallel to the ground.

10. The multifunctional cleaning device as claimed in claim 1, further comprising a carrier unit correspondingly mounted on the main body, the carrier unit serving to carry and transfer at least one article.

* * * * *